United States Patent [19]

Emmett, Jr. et al.

[11] 4,217,916

[45] Aug. 19, 1980

[54] COUNTERCURRENT WASHER

[75] Inventors: Robert C. Emmett, Jr., Salt Lake City; Lawrence L. Tuttle, Sandy, both of Utah

[73] Assignee: Envirotech Corporation, Menlo Park, Calif.

[21] Appl. No.: 25,758

[22] Filed: Apr. 2, 1979

[51] Int. Cl.[3] ..... B08B 3/04

[52] U.S. Cl. ..... 134/104; 134/25 R

[58] Field of Search ..... 134/25 R, 104, 132, 134/134, 154–155

[56] References Cited

U.S. PATENT DOCUMENTS

| | | | |
|---|---|---|---|
| 3,650,830 | 3/1972 | Mathis | 134/25 R X |
| 3,741,223 | 6/1973 | Kavera et al. | 134/25 R X |
| 3,801,370 | 4/1974 | Porter et al. | 134/25 R |

*Primary Examiner*—Robert L. Bleutge

*Attorney, Agent, or Firm*—Robert R. Finch; T. S. MacDonald; Robert E. Krebs

[57] ABSTRACT

Apparatus for countercurrent washing of finely divided solids comprising a vertical tank divided by transverse plates into a plurality of superimposed compartments, a single opening in each plate, a rake in each compartment for scraping settled solids on the plate to the opening, an inlet in the uppermost compartment for introducing solids, an outlet in the bottom of the lowermost compartment for discharge of settled solids, a wash liquor inlet in a lower zone of the lowermost compartment, a wash liquor outlet in the uppermost compartment for liquid discharge and valves for regulating the rate of introduction of both solids at the top of the tank and wash liquor at the bottom. Tubular components may depend from the edge of the single opening in each plate.

4 Claims, 3 Drawing Figures

COUNTERCURRENT WASHER

FIELD OF THE INVENTION

This invention relates to wet processing of finely divided solids and in particular to improved ways and means to effect contact of the solids by a wash or reactant.

It is common practice to subject finely divided solids, such as ores, to beneficiation in which the fine solids are subjected to a leach then separated from the leach liquor for processing of the solids or dissolved values. In such cases, it is necessary to subject the solids to a washing step which is frequently carried out in one or more sedimentation tanks through which the solids pass sequentially, often countercurrently to the wash liquor. Although such countercurrent operations are fairly effective, they suffer from the disadvantages, inter alia, of large space requirements and the need for extra handling such as repulping of the settled solids between wash stages. Moreover, the washing is usually a quiescent operation in which the solids are washed by contact with liquid as they settle in the sedimentation tank and there is no real dynamic or displacement washing taking place.

SUMMARY OF THE INVENTION

It is the primary object of this invention to provide improved ways and means for continuous countercurrent washing of finely divided solids.

Another object is a provision of compact apparatus for effecting countercurrent solids washing in a single vessel.

Still another object is the provision of a method of operation in which solids passing through a multicompartment wash vessel are subject to controlled contact with wash liquid whereby to effect efficient displacement wash thereof.

In accordance with the invention, the wash apparatus comprises a tank, defined by a bottom and a marginal sidewall of substantial vertical extent, a plurality of spaced-apart plates located transversely in the tank defining a plurality of superimposed wash compartments, an opening in each plate, rake means in each compartment arranged to rake solids settled on the plate to the opening therein, a solids inlet in the upper compartment above the bottom thereof, a solids outlet adjacent the bottom of the lowermost compartment, a wash liquor inlet adjacent the bottom of lower wash compartment in the tank, a wash liquor discharge adjacent the top of the tank above the plate of the uppermost compartment and means for regulation of the relative countercurrent movement between the solids and liquid during passage through the tank.

The tank size, the size of compartments, the diameter of the transfer openings, rake speeds, rate of solids feed and wash liquor introduction are all coordinated having regard to the solids characteristics to achieve the desired washing. In brief, it is desired that the solids flow downward through the tank countercurrent to wash liquor flowing upwardly therethrough. The flow rates are selected—usually empirically—so that solids settle briefly on the bottom plate of each compartment then are raked to the opening through which they descend into the subadjacent compartment. Solids descend from compartment to compartment in opposition to the rising wash liquid. In the area adjacent the openings, the solids meet the highest liquid flow rate and it is here where the solids approach a hindered settled state with some agitation present. This area is where substantial displacement of liquor from descending solids occur. Considerable washing of solids also occurs in each compartment as the settled solids are agitated as they are raked across the plate to the outlet opening therein.

It is significant that the solids pass repeatedly through several phases as they progress through the tank. For instance, when the solids are first introduced into the top compartment they are dispersed in a relatively large liquor volume and low liquor flow rate. Under these conditions, the solids settle through the liquor onto the plate. After settling, the solids, which are in their densest state, are raked to the opening in the plate through which they drop into the next compartment. This raking stirs the solids and effects additional liquid contact and even displacement. Since the opening is relatively small compared to the compartment diameter, the rate of liquor upflow is quite rapid. Thus the solids become dispersed as they drop through the opening. Assuming the flow rate has been correctly chosen, the result is that the solids passing through the opening are at least temporarily held in a condition of hindered settling in the uprising liquor. Thereafter, the solids disperse in the compartment, again settle and again are stirred as they are raked to the opening for passage to the next lower compartment.

In summary, as the solids progress downwardly they pass sequentially through several degrees of density and settling rates. Where a dilute suspension exists in each compartment, the highest settling rate occurs to a maximum density as settled on the plate. This is followed by a low settling rate as the solids drop through the opening where, because of relatively increased velocity of the counter flowing liquor, the settling is hindered. On the other hand, the upflowing liquor exhibits just the opposite rates. That is, the flow rate is highest through the tubes or restricted plate openings and lowest when it flows through the relatively larger volume of the compartment proper. Feed slurry (solids) input and wash liquor flow rates are adjusted so the solids discharge matches input. Liquor overflow matches input.

Since there is true countercurrent flow of solids and liquids through the tank, washing is at maximum efficiency. Additional benefits may be achieved by selecting different modifications of transfer passages between compartments. For instance, with some materials, optimum results may be obtained with a simple orifice in the plate through which the solids fall. In other cases, a vertical transfer tube may depend from the outlet periphery into the compartment and sometimes the tube may have special baffles connected thereto. These are all discussed in connection with the drawings.

In order that the invention may be more readily understood and carried into effect, reference is made to the accompanying drawings and description thereof which are offered by way of illustration only and not in limitation of the invention, the scope of which is defined by the appended claims, including equivalents, rather then by the drawings or other description thereof.

DETAILED DESCRIPTION OF THE INVENTION

Figure 1:
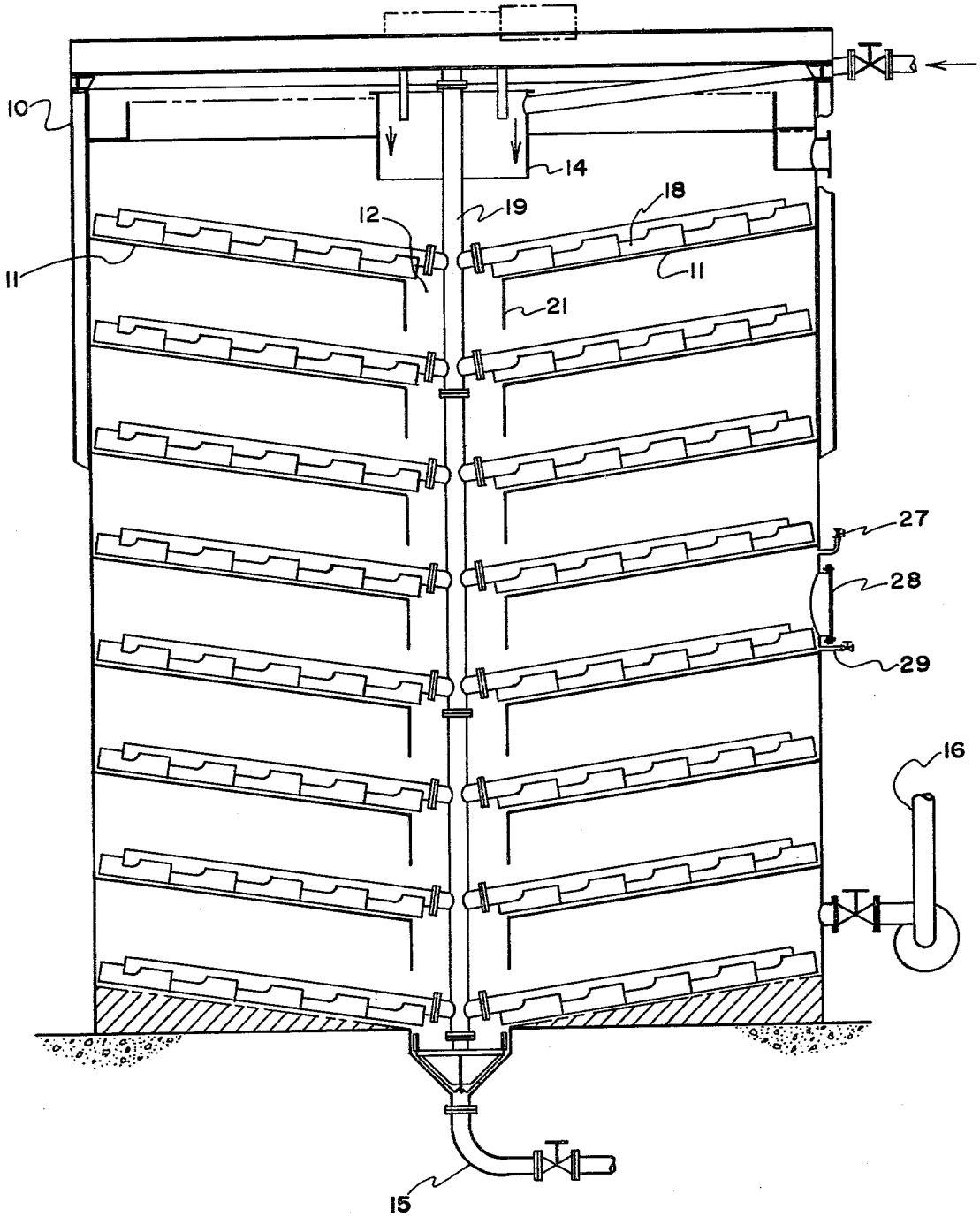
FIG. 1 is a simplified drawing illustrating in section a multicompartment tank embodying the invention.

The wash vessel comprises a relatively tall tank 10, divided by a plurality of spaced-apart transverse plates or trays 11 into a plurality of superimposed compartments. There is a central opening 12 in each plate from the edge of which depends a tubular skirt 21. Finely divided solids are fed into the upper compartment via a suitable inlet 14 and discharged from the bottom compartment via a suitable outlet 15. Wash liquor is introduced to the bottom compartment of the tank via suitable valve and pump assembly and discharged from the top compartment over a weir and associated discharge port. Pumps and other metering devices will be employed to regulate the rate of wash liquor introduction. The degree of fineness and rate of supply of solids can be readily controlled by known techniques.

A rake mechanism including rake arms 17 and blades 18 is located in each compartment. The arms are connected to a common center shaft 19 in turn connected to a drive for rotation.

As shown in FIG. 1, a vertical skirt or baffle 21 depends from the edge of the opening 12 in each plate. This increases the effectiveness of the wash, probably because of a prolonged hindered settling state during which the slowly descending solids are contacted with a relatively high volume of upflowing liquor.

Air vents 27, maintenance access hatches 28 and sampler valves 29 may be provided as needed.

Figure 2:
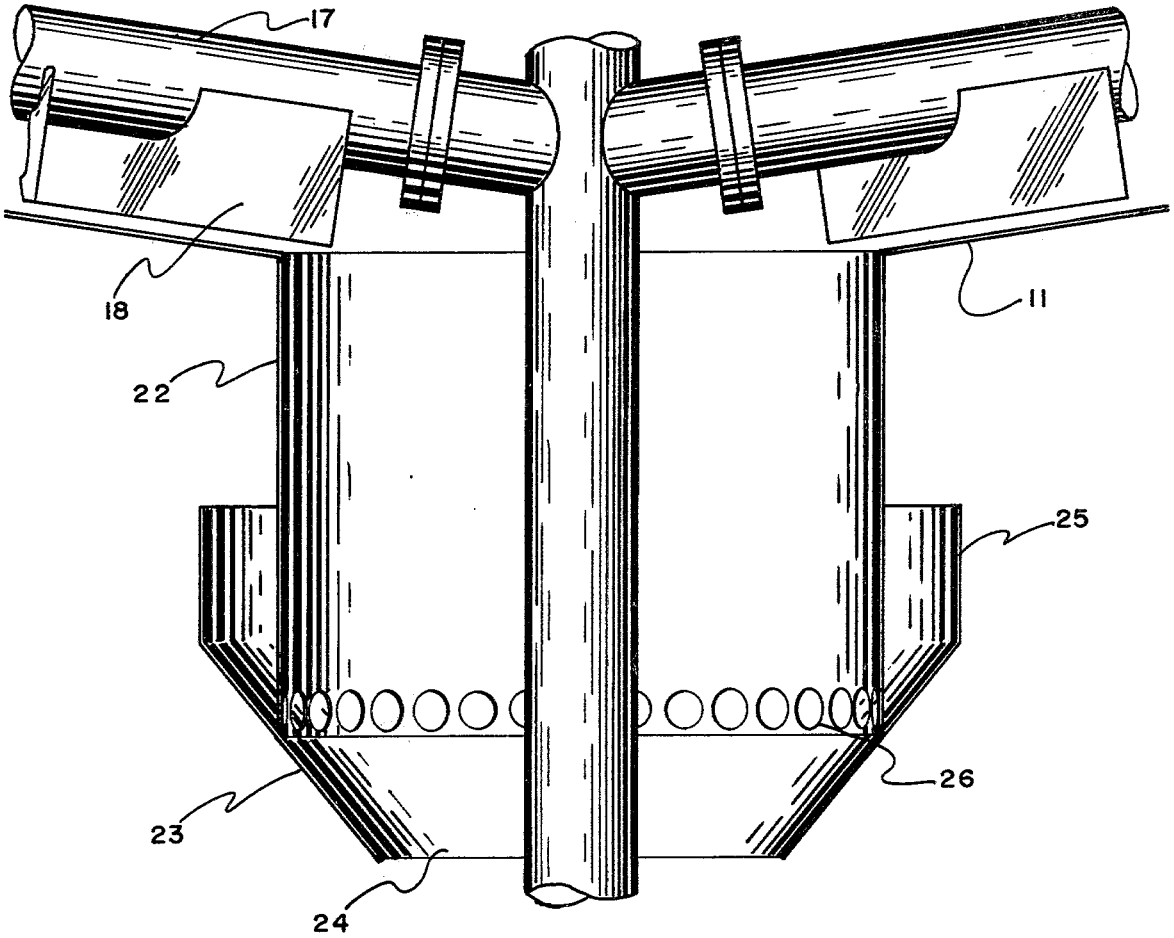
FIGS. 2 and 3 are partial view showing modifications of the solids transfer passages useful under different conditions in the wash apparatus of FIG. 1.

An apparatus modification embodying a variation of the tubular transfer tube is illustrated in FIG. 2 wherein a straight tube or baffle portion 22 depends from the edge of the transfer opening 13 but terminates in an inturned sloping annular lip 13 at the bottom. Thus, the solids and liquids undergo several changes as they pass through the tube. For instance, as the solids pass through the bottom opening 24 they are compressed into a relatively smaller area before dropping into the next compartment. Thus, the solids are relatively dense as they leave the compartment and enter the next one. For reasons that are not apparent, this increases the wash efficiency compared to the straight wall transfer tube. In order to compensate for the reduced area of opening 24, a plurality of ports 26 are provided in the wall just above the sloping lip 23. These ports allow some wash liquor to pass into the tube thus avoiding the danger of upset due to an increased liquor flow velocity in opening 24 that would occur if these ports were not provided. Additionally, the inflow through the ports insures distribution of wash liquor throughout the transfer tube thus enhancing liquid solids contact. A baffle 25, concentric to the tube, requires the upflowing liquid to reach the upper portion of the chamber. This also increases wash efficiency.

Figure 3:
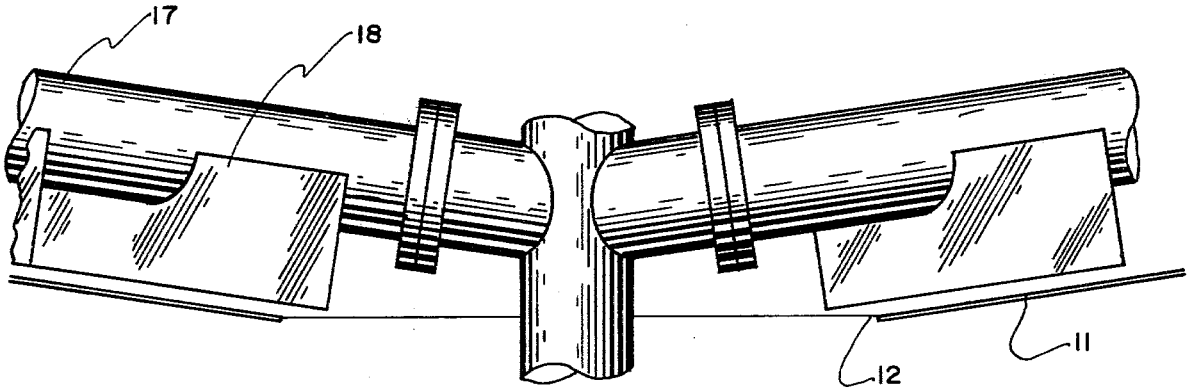

FIG. 3 illustrates the simplest form of transfer opening comprising a simple orifice 12 through the plate.

As described, it is contemplated that the wash be conducted in true countercurrent flow. For that reason, no provision is made for any recycle of effluent.

We claim:

1. Apparatus for washing finely divided solids comprising a vertical tank, a plurality of spaced-apart transverse plates in said tank defining therein a plurality of superimposed compartments, a single opening in each providing the sole communication between compartments, an inlet in the top compartment for introducing finely divided solids and an outlet in the bottom compartment for discharge of solids, means for introducing wash liquid into the bottom compartment and for discharging it from the top compartment, rake means in each compartment for raking solids settled on the plate therein to said opening; and means for regulating the rate of wash liquor supply to said bottom compartment and flow through said openings to enable countercurrent flow of solids through said tank with respect to wash liquid uprising therethrough.

2. Apparatus according to claim 1 with the addition of a tube depending from the edge of each opening in each plate to terminate in the next lower compartment above the bottom plate therein.

3. Apparatus for washing finely divided solids comprising a vertical tank, a plurality of spaced-apart transverse plates in said tank defining therein a plurality of superimposed compartments, a single opening in each plate providing the sole communication between compartments, a tube depending from the edge of each opening in each plate to terminate in the next lower compartment above the bottom plate therein each of said tubes having secured to the bottom thereof an upward sloping lip defining a bottom outlet smaller then said tube and there being a plurality of ports in the wall of said tube, an inlet in the top compartment for introducing finely divided solids and an outlet in the bottom compartment for discharge of solids, means for introducing wash liquid into the bottom compartment and for discharging it from the top compartment, rake means in each compartment for raking solids settled on the plate therein to said opening; and means for regulating the rate of wash liquor supply to said bottom compartment and flow through said openings to enable countercurrent flow solids through said tank with respect to wash liquid uprising therethrough.

4. Apparatus according to claim 3 with the addition of a concentric baffle spaced from said tube and extending upward to terminate below said plate.

* * * * *